United States Patent [19]

Brown

[11] Patent Number: 5,054,751

[45] Date of Patent: Oct. 8, 1991

[54] NOTCHED SPAN FOR PRESS-FIT MOUNTED SPRINGS

[75] Inventor: Daniel E. Brown, Chicago, Ill.

[73] Assignee: The Ohio Mattress Company Licensing and Components Group, Cleveland, Ohio

[21] Appl. No.: 468,554

[22] Filed: Jan. 23, 1990

[51] Int. Cl.[5] ..... F16F 3/02

[52] U.S. Cl. ..... 267/103; 267/100

[58] Field of Search ..... 5/247, 255, 263, 264.1; 267/91, 100, 101–109, 179, 182; 248/225.1, 617; 211/184, 208; 403/207, 346, 347

[56] References Cited

U.S. PATENT DOCUMENTS

| | | | |
|---|---|---|---|
| 1,095,712 | 4/1914 | D'arcy | 5/264.1 |
| 1,299,890 | 4/1919 | Young | 267/100 X |
| 3,506,987 | 4/1970 | Bielak | 5/203 |
| 3,755,833 | 9/1973 | Slominski | 5/247 |
| 3,858,862 | 1/1975 | Cliampa et al. | 267/100 |
| 3,916,463 | 11/1975 | Higgins | 5/264.1 |
| 3,971,081 | 7/1976 | Roe | 5/246 |
| 4,003,564 | 1/1977 | Taylor | 267/108 |
| 4,136,983 | 1/1979 | Dobberpuhl | 403/347 X |
| 4,470,584 | 9/1984 | Mizelle | 267/103 |
| 4,570,400 | 2/1986 | Slager et al. | 403/347 X |
| 4,776,572 | 10/1988 | Surletta et al. | 5/247 X |
| 4,779,292 | 10/1988 | Dabney | 267/100 X |
| 4,861,002 | 8/1989 | Dabney | 5/247 X |

*Primary Examiner*—Robert J. Oberleitner
*Assistant Examiner*—Alfred Muratori
*Attorney, Agent, or Firm*—Willian Brinks Olds Hofer Gilson & Lione

[57] ABSTRACT

A frame for a spring assembly has a plurality of parallel transverse cross rails with mounting slots that form openings through the top portion of the cross rail. Springs are firmly secured to the cross rails by inserting foot portions of the springs into the mounting slots by a simple press fit.

9 Claims, 1 Drawing Sheet

NOTCHED SPAN FOR PRESS-FIT MOUNTED SPRINGS

FIELD OF THE INVENTION

This invention generally relates to spring assemblies, such as used in furniture, cushions, and bedding, and more particularly to a box spring assembly which utilizes torsion bar springs that are press-fit mounted on a notched cross-span.

BACKGROUND OF THE INVENTION

Spring assemblies for seat cushions, bedding and other furniture are well known. The springs are typically arranged in rows and columns to define a load supporting base. The tops of the springs, e.g., the upper terminal convolutions, are generally tied together using twine, cross-helicals and the like, or clipped to a mesh or gridwork. The lower ends, or feet, of the springs are united in a similar fashion, as in a mattress or cushion, or fixed to a framework, as in a bedding foundation. It is in the environment of a bedding foundation, i.e., box spring, that the present invention has found particular application.

A box spring generally used has a wood base frame upon which springs are mounted. Coil springs or torsion bar springs are typically used. The frame has wooden side and end rails defining its perimeter, with wood cross rails, or spans, extending between the side rails. The feet of the springs are stapled directly to the frame members.

Stapling of the springs is primarily a manual operation which depends on the skill of the worker for appropriate positioning and fixing of the springs on cross rail at the appropriate position detracts from the performance of the unit. Staples can also loosen or pull out, further impairing the performance of the unit. This method of assembly is slow and labor intensive, also requiring the use of heavy-duty staplers.

Another type of box spring assembly is disclosed in Mizelle, U.S. Pat. No. 4,470,584, which utilizes channel-shaped metal cross rails having horizontal spring mounting slots. In the '584 patent, the torsion bar springs are mounted directly to the cross rails by inserting the feet of the springs horizontally through slots running lengthwise through the sides of the cross rail. Although this method of assembly will firmly secure the spring in a consistently correct position without using staples, the twisting horizontal movement of the spring necessary for insertion is difficult to perform by automated assembly machinery, and is instead performed by hand labor. Even so, the twisting motion required for spring mounting in the '584 patent adds a measure of difficulty for the worker.

SUMMARY OF THE INVENTION

A principal objective of this invention is to provide an improved spring assembly in which the springs can be attached to the frame efficiently by automated assembly machinery, or by a minimum of hand labor. To this end, the present invention comprises an improved spring assembly in which the springs are mounted to a frame by a simple downward push of the spring into mounting slots located on the top surface of the frame cross rails.

A box spring frame assembly which embodies this invention comprises a generally rectangular frame having side rails, end rails, and spaced supporting metal cross rails attached at their ends to the side rails. The cross rails have a plurality of spring mounting slots formed width-wise across the cross rail. The slots define openings through the top surface of the cross rail which extend downwardly through the sides of the cross rail. The slots are preferably angled at a point to cause some loading on the spring feet in the course of insertion to thereby lock the springs in place. These mounting slots allow for mounting of springs onto the cross rails by a simple press-fit of the wire springs into the mounting slots.

This vertical assembly of springs, and torsion bar type springs in particular, is simpler to adapt to automated assembly machinery compared to spring attachment assembly means used in prior inventions. Thus, a torsion bar box spring unit may be assembled with less manual labor, in less time, and with less cost in comparison to prior box spring units of this type.

These and other objects and advantages of the invention will be further understood upon consideration of the following detailed description of an embodiment of the invention taken in conjunction with the accompanying drawings, in which:

DETAILED DESCRIPTION OF A PRESENTLY PREFERRED EMBODIMENT

Figure 2:
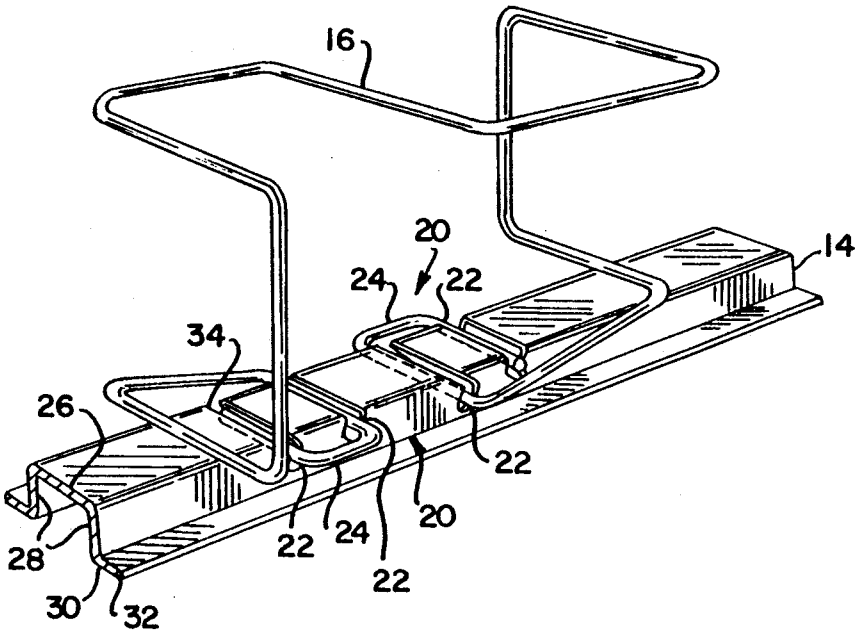
FIG. 2 is an enlarged fragmentary perspective view of a portion of a cross rail shown in FIG. 1.

A box spring assembly embodying the features of the present invention is generally indicated by reference numeral 10. The box spring assembly 10 comprises a base frame 12 having end rails **12*a* and side rails 12*b* (only one of each being shown) A plurality of parallel cross rails 14 extend across the side rails 12*b*. A plurality of torsion bar springs 16 of the type shown in Mizelle, U.S. Pat. No. 4,470,584, are mounted upon and attached to the cross rails 14**.

The torsion bar spring 16 shown (FIG. 2) has two horizontal attaching feet 20. Each attaching foot 20 consists of two bars 22 which are substantially parallel to each other. The two bars 22 are joined by a connecting segment 24, so as to form the generally U-shape attaching foot 20. All four bars 22 of each spring lie in the same horizontal plane and are substantially parallel to each other.

The cross rails 14 are made from a strong rigid material, such as rolled and formed steel The cross rails 14 have an inverted U-shape cross section, with a top portion or web 26 which connects two horizontally spaced upright side portions 28. Each of the side portions 28 terminates at its lower end in an outwardly extending generally horizontal flange 30 which has a slightly upturned end section 32.

Figure 3:
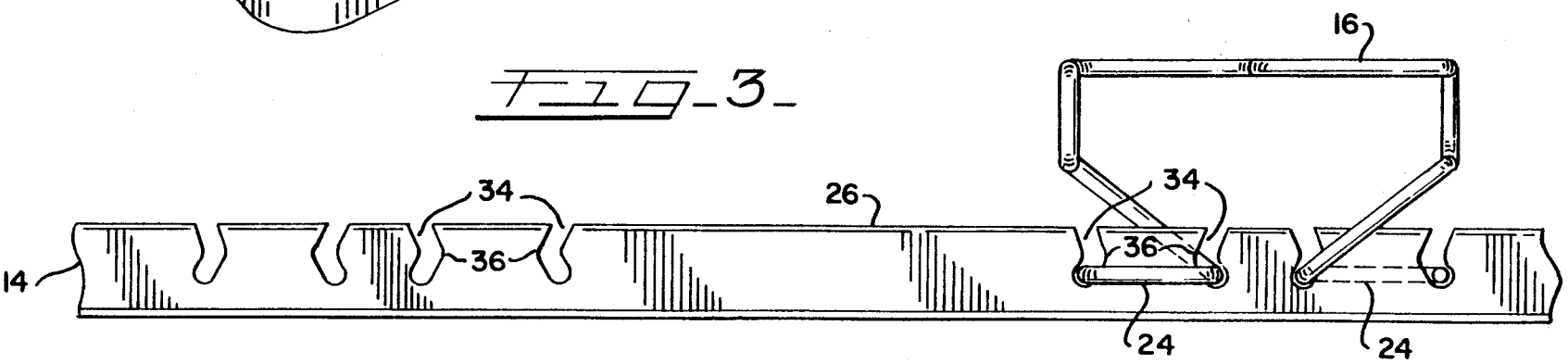
FIG. 3 is an enlarged elevational view of part of a cross rail shown in FIG. 1.
Figure 1:
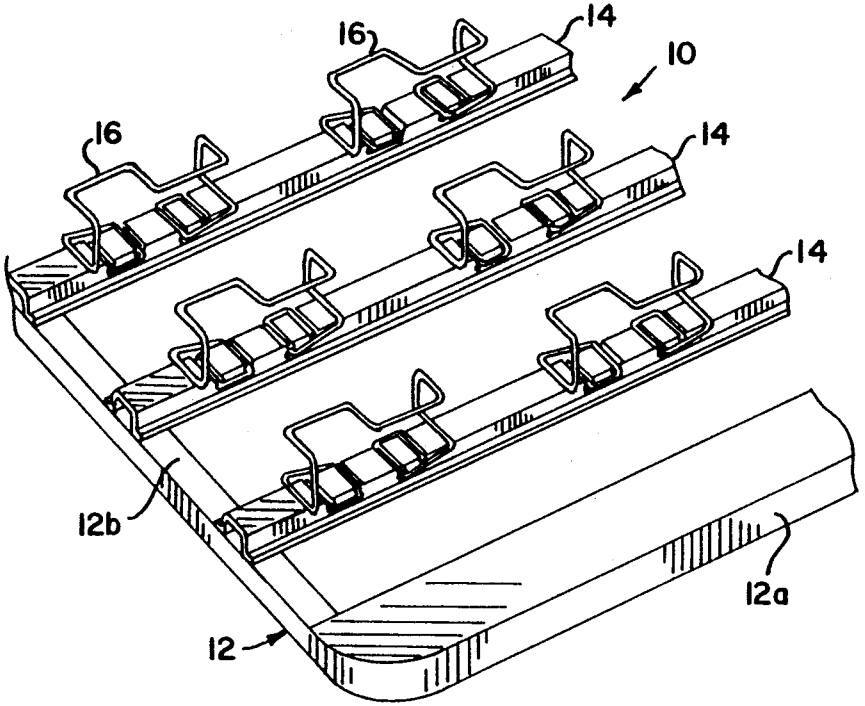
FIG. 1 is a fragmentary perspective view of the interior of a box spring unit utilizing torsion bar springs and embodying the features of the present invention.

Each cross rail 14 has a plurality of mounting slots 34 adapted to receive and firmly secure the attaching feet 20 of the torsion bar springs 16. The mounting slots form cross-wise openings through the top portions 26 of the cross rails 14 and extend into the side portions 28. The mounting slots 34 typically extend to a depth of 0.5 inches in side portions 28 having a vertical height of 1.0 inches. As shown in FIG. 3, the mounting slot 34 geometry in the side portions 28 is of a shallow V-shape configuration (if viewed rotated 90 degrees from the vertical) with a vertex 36. The mounting slots 34 terminate at a position below and nearly vertical from the mounting slot 34 openings on the top portion 26 of the cross rail 14. The mounting slots 34 are formed in the metal by a punching operation before the metal is rolled into channel shaped cross rails 14. A slight inward lip (not shown) is advantageously formed at the bottom of the mounting slot 34 during the punching operation which serves to increase the bearing surface for the spring attaching feet 20.

The mounting slots 34 are shown grouped into sets of four corresponding with the four bars 22 of each torsion spring 16. The spacing of a group of mounting slot openings matches the undeflected spacing of the four bars 22 of torsion bar spring 16. A potentially significant advantage of the present invention is the ability to form a "universal cross rail" having mounting slots 34 available for each box spring configuration in a product line The need for different cross rails for different products could thereby be reduced or eliminated.

To attach a torsion bar spring 16 to the cross rail 14, the torsion bar spring 16 is first positioned directly above the cross rail 14 with its four attaching bars 22 vertically aligned to a corresponding group of four mounting slots 34. Second, the torsion bar spring 16 is moved vertically downward until the bars 22 enter the mounting slot 34 openings Next, a vertical downward force is applied to the torsion bar spring 16 sufficient to elastically deflect the bars 22 as they slide past the mounting slot vertices 36. After the bars 22 pass the vertices 36, they return to an undeflected position as they reach the bottom of the mounting slots 34.

The shallow V-shape geometry of the mounting slot 34 prevents the attaching feet 20 from moving out of the bottom of the mounting slots 34 once inserted. The torsion bar spring 16 may only be removed from the cross rail 14 by applying a vertical upward force to the attaching feet 20 sufficient to deflect the bars 22 past the mounting slot vertices 36. Such upward vertical forces are not encountered during the use of the box spring assembly 10, and thus the torsion bar springs 16 will remain firmly secured in their mounted position.

It should be understood that various changes and modifications to the preferred embodiment described above will be apparent to those skilled in the art. For example, different mounting slot geometries can be utilized allowing vertical assembly of the torsion bar springs 16 to the cross rail 14 while at the same time firmly securing the attaching feet 20. It is therefore intended that the foregoing detailed description be regarded as illustrative rather than limiting, and that the following claims, including all equivalents, are intended to define the scope of the invention.

I claim:

1. A cross rail for a spring assembly which includes a plurality of wire springs, each wire spring having an attaching foot including a pair of generally opposed substantially parallel segments, comprising:

a channel-shaped elongated cross rail member having a longitudinal axis, a top portion and side portions depending from said top portion, and paired mounting slots defined in said cross rail member for mounting of a spring attaching foot therein, said slots beginning at said top portion in an opening extending cross said top portion, then extending into said side portions in a direction generally following a plane which is perpendicular to said cross rail member longitudinal axis, and terminating at a point generally aligned with said top portion opening and along said plane, whereby a spring is mounted on the cross rail be inserting the pair of parallel segments of the spring into a respective pair of slot openings and then pressing the segments into said mounting slots with a force applied substantially only in the direction of said plane.

2. The cross rail for a spring assembly of claim 1 wherein said mounting slots extend into said side portions in a V-shaped configuration.

3. The cross rail of claim 1 in which said mounting slots define a path between said top portion and said terminating point which path deviates from said plane in a direction parallel to said cross rail member longitudinal axis at a place between said mounting slot opening and said terminating point.

4. A generally rectangular frame for a box spring assembly having a plurality of wire springs, each spring having an attaching foot including a pair of generally opposed substantially parallel segments, the rectangular frame comprising: side rails, end rails, and spaced supporting cross rails extending between said side rails and connected thereto, said cross rails being formed of a rigid material and having a top portion and upright side portions, said cross rails having a plurality of mounting slots that form mounting slot openings through said top portion extending into said side portions, whereby each of said springs can be attached to said cross rails by inserting the parallel segments thereof into a pair of mounting slots and pressing said spring into said slots with a force only applied perpendicular to said cross rail top portion.

5. The frame of claim 4 wherein said mounting slot opening are located along said top portion of the said cross rail at spacings matchings an undeformed spacing of the parallel segments of the wire springs.

6. The box spring assembly of claim 4 wherein said mounting slots have a V-shaped slot configuration with vertices and extend into said side portions in a direction generally perpendicular to said top portion, said slot configuration deflecting said parallel segments from an undeformed spacing at said vertices of said V-shape, and then permitting said parallel segments to return toward said undeformed spacing after passing said vertices.

7. The frame of claim 4 in which said mounting slots define a path between said top portion and a terminating point which path deviates from a plane which is perpendicular to said top portion in a direction parallel to a cross rail member longitudinal axis at a place between said mounting slot opening and said terminating point.

8. A cross rail for a spring assembly which includes a plurality of wire springs, each wire spring having an attaching foot including a pair of generally opposed substantially parallel segments, comprising:

a channel-shaped elongated cross rail member having a longitudinal axis, a top and opposed side portions with paired mounting slots defined in said cross rail member for mounting of a spring attaching foot therein, each of said slots beginning at said top in an opening in each of said side portions and then extending into each of said side portions in a direction generally following a plane which is perpendicular to said cross rail member longitudinal axis, and terminating at a point generally aligned with said opening and along said plane, a spring being mounted on said cross rail member by inserting each of its parallel segments into a respective pair of slot openings and then pressing the parallel segments into said mounting slots with a force applied substantially only in the direction of said plane.

9. A box spring assembly comprising:

a plurality of wire springs, each spring having an attaching foot including a pair of generally opposed substantially parallel segments, and a rectangular frame having side rails, end rails, and spaced supporting cross rails extending between the side rails and connected thereto, said cross rails each further being comprises of a cross rail member formed of a rigid material and having a top portion and upright side portions, with a plurality of mounting slots that form openings through said top portion and then extend into said side portions in a direction generally following a plane which is perpendicular to a cross rail member longitudinal axis and terminate at a point generally aligned with a respective top portion opening and along said plane, the springs being attached to said cross rails by inserting the parallel segments of the spring into a pair of mounting slots and pressing the spring into said mounting slots with a force only applied perpendicular to said cross rail top portion.

* * * * *